US010248076B2

(12) United States Patent
Kamimura

(10) Patent No.: US 10,248,076 B2
(45) Date of Patent: Apr. 2, 2019

(54) CARTRIDGE WITH MOVABLE JOINT AND IMAGE FORMING APPARATUS

(71) Applicant: BROTHER KOGYO KABUSHIKI KAISHA, Nagoya-shi, Aichi-ken (JP)

(72) Inventor: Naoya Kamimura, Ichinomiya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 396 days.

(21) Appl. No.: 14/600,233

(22) Filed: Jan. 20, 2015

(65) Prior Publication Data

US 2015/0132023 A1 May 14, 2015

Related U.S. Application Data

(63) Continuation of application No. 13/931,908, filed on Jun. 29, 2013, now abandoned, which is a (Continued)

(30) Foreign Application Priority Data

Jan. 29, 2010 (JP) ..... 2010-018607

(51) Int. Cl.
*G03G 21/18* (2006.01)
*G03G 15/08* (2006.01)
*G03G 21/16* (2006.01)

(52) U.S. Cl.
CPC ..... *G03G 21/18* (2013.01); *G03G 15/08* (2013.01); *G03G 21/1676* (2013.01)

(58) Field of Classification Search
CPC ..... G03G 21/18; G03G 21/1676; G03G 15/08
(Continued)

(56) References Cited

U.S. PATENT DOCUMENTS 7,162,176 B2 1/2007 Oguma et al.
2006/0093398 A1 5/2006 Hayakawa
(Continued)

FOREIGN PATENT DOCUMENTS

JP H06-159447 A 6/1994
JP H09-177807 A 7/1997
(Continued)

OTHER PUBLICATIONS

Japan Patent Office, Decision of Patent Grant for Japanese Patent Application No. 2010-018607 (counterpart to co-pending U.S. Appl. No. 13/017,735), dated Dec. 20, 2011.
(Continued)

*Primary Examiner* — Billy James M Lactaoen
(74) *Attorney, Agent, or Firm* — Merchant & Gould P.C.

(57) ABSTRACT

A cartridge includes: a rotational body; a joint member having a first joint-side engagement part configured to be engaged to a rotational body-side engagement part with a predetermined moving range in a rotational direction, and a press member, wherein the joint member has a second joint-side engagement part configured to be engaged with a transfer-side engagement part with central axes of the joint member and the driving force transfer member being substantially matched, and wherein when the second joint-side engagement part is contacted to the driving force transfer member at a position at which the central axes of the joint member and the driving force transfer member are not matched, the joint member is rotated within the predetermined range and the second joint-side engagement part is thus moved, so that the second joint-side engagement part is engaged with the transfer-side engagement part in the rotational direction.

13 Claims, 9 Drawing Sheets

Related U.S. Application Data continuation of application No. 13/017,735, filed on Jan. 31, 2011, now Pat. No. 8,498,553.

(58) Field of Classification Search
USPC ..... 399/119, 111, 110, 117, 167
See application file for complete search history.

(56) References Cited

U.S. PATENT DOCUMENTS

| | | | | |
|---|---|---|---|---|
| 2006/0153590 | A1 | 7/2006 | Igarashi | |
| 2007/0036586 | A1 | 2/2007 | Funamoto | |
| 2007/0122188 | A1 | 5/2007 | Igarashi | |
| 2008/0170880 | A1 | 7/2008 | Hashimoto | |
| 2008/0260428 | A1 | 10/2008 | Ueno et al. | |
| 2008/0286004 | A1* | 11/2008 | Kimizuka ..... | G03G 21/1853 399/119 |
| 2009/0196655 | A1* | 8/2009 | Takigawa ..... | G03G 21/186 399/167 |
| 2009/0317132 | A1 | 12/2009 | Asanuma et al. | |
| 2009/0317135 | A1* | 12/2009 | Miyabe ..... | G03G 21/186 399/119 |
| 2010/0054823 | A1 | 3/2010 | Takasaka et al. | |
| 2011/0188889 | A1 | 8/2011 | Kamimura | |

FOREIGN PATENT DOCUMENTS

| | | | |
|---|---|---|---|
| JP | H11-315891 | A | 11/1999 |
| JP | 2004-004959 | A | 1/2004 |
| JP | 2006-154746 | A | 6/2006 |
| JP | 2006-189737 | A | 7/2006 |
| JP | 2007-072448 | A | 3/2007 |
| JP | 2007-147881 | A | 6/2007 |
| JP | 2008-170961 | A | 7/2008 |
| JP | 2010-002689 | A | 1/2010 |

OTHER PUBLICATIONS

The State Intellectual Property Office of the People's Republic of China, Notification of First Office Action for Chinese Patent Application No. 201110034258.X (counterpart to co-pending U.S. Appl. No. 13/017,735), dated Jun. 13, 2012.

* cited by examiner

CARTRIDGE WITH MOVABLE JOINT AND IMAGE FORMING APPARATUS

CROSS REFERENCE TO RELATED APPLICATION

The present application is a continuation application of U.S. patent application Ser. No. 13/931,908, filed Jun. 30, 2013, which is a continuation of U.S. patent application Ser. No. 13/017,735, filed on Jan. 31, 2011, both of which claim priority from Japanese Patent Application No. 2010-018607, filed on Jan. 29, 2010, the disclosure of both of which are incorporated by reference in their entirety.

TECHNICAL FIELD

The present invention relates to a cartridge that is detachably mounted to a main body of an image forming apparatus and to which driving force is transferred from a driving force transfer member rotatably provided to the main body and an image forming apparatus having the cartridge.

BACKGROUND

An image forming apparatus has been known which has a process cartridge detachably mounted to a main body and a driving force transfer member provided to the main body and engaged to a coupling of the process cartridge in a rotational direction to transfer driving force to the coupling. Specifically, according to this technology, the driving force transfer member is axially advanced and retreated to and from the coupling, so that the driving force transfer member and the coupling are connected and disconnected.

SUMMARY

However, according to the above described apparatus, the main body is axially enlarged so as to axially advance and retreat the driving force transfer member.

Accordingly, an object of the invention is to provide a cartridge and an image forming apparatus in which a main body can be made to be small.

According to a first illustrative aspect of the present invention, there is provided a cartridge that is detachably mounted to a main body of an image forming apparatus and to which driving force is transferred from a driving force transfer member rotatably provided to the main body, the cartridge comprising: a rotational body that is rotatably supported to a case of the cartridge; a joint member that is coaxially arranged to an end portion of the rotational body in an axial direction of the joint member and has a first joint-side engagement part that is configured to be engaged to a rotational body-side engagement part provided to the end portion of the rotational body with a predetermined moving range in a rotational direction, and a press member that presses the joint member to a position in which the predetermined moving range is secured, wherein the joint member has a second joint-side engagement part that is configured to be engaged with a transfer-side engagement part provided to the driving force transfer member in the rotational direction with central axes of the joint member and the driving force transfer member being substantially matched, and wherein while the cartridge is mounted to the main body, when the second joint-side engagement part is contacted to a part of the driving force transfer member at a position at which the central axes of the joint member and the driving force transfer member are not matched, the joint member is rotated within the predetermined range and the second joint-side engagement part is thus moved, so that the central axes of the joint member and the driving force transfer member are substantially matched and the second joint-side engagement part is engaged with the transfer-side engagement part in the rotational direction.

According to a second illustrative aspect of the present invention, there is provided an image forming apparatus comprising a main body having a driving source and a cartridge detachably mounted to the main body, wherein the main body includes a driving force transfer member that is rotated as driving force is transferred thereto from the driving source, wherein the cartridge has: a rotational body that is rotatably supported to a case of the cartridge, a joint member that is coaxially arranged to an end portion of the rotational body in an axial direction of the joint member and has a first joint-side engagement part that can be engaged to a rotational body-side engagement part provided to the end portion of the rotational body with a predetermined moving range in a rotational direction, and a press member that presses the joint member to a position in which the predetermined moving range is secured, wherein the driving force transfer member has a rotational shaft part that protrudes toward the joint member and a transfer-side engagement part that is provided at a position that is diametrically offset with regard to the rotational shaft part, wherein the joint member has a second joint-side engagement part that can be engaged with the transfer-side engagement part in the rotational direction with central axes of the joint member and the driving force transfer member being substantially matched, and wherein while the cartridge is mounted to the main body, when the second joint-side engagement part is contacted to a part of the driving force transfer member at a position at which the central axes of the joint member and the driving force transfer member are not matched, the joint member is rotated within the predetermined range and the second joint-side engagement part is thus moved, so that the central axes of the joint member and the driving force transfer member are substantially matched and the second joint-side engagement part is engaged with the transfer-side engagement part in the rotational direction.

According to the cartridge and the image forming apparatus, when the second joint-side engagement part is contacted to a part (for example, rotational shaft part) of the driving force transfer member in mounting the cartridge to the main body, the joint member is rotated within a predetermined moving range, so that the second joint-side engagement part is moved. Accordingly, since the second joint-side engagement part is caught at the part of the driving force transfer member and the moving of the cartridge is not restrained, it is possible to securely match the central axes of the joint member and the driving force transfer member. In this structure, since the joint member and the driving force transfer member are engaged just by moving the joint member toward the driving force transfer member in a diametrical direction, it is possible to make the main body smaller in an axial direction, compared to a structure in which a driving force transfer member is axially advanced and retreated to and from a main body and is thus connected to a cartridge.

According to a third illustrative aspect of the present invention, there is provided a cartridge that is detachably mounted to a main body of an image forming apparatus and to which driving force is transferred from a driving force transfer member rotatably provided to the main body, the cartridge comprising: a rotational body that is rotatably supported to a case of the cartridge, and a joint member that is rotatably supported to the case of the cartridge and transfers driving force to the rotational body, wherein the joint member comprises a rotational shaft part that protrudes toward the driving force transfer member and two joint-side engagement parts that are formed to sandwich the rotational shaft part and can be engaged with two transfer-side engagement parts provided to the driving force transfer member with central axes of the joint member and the driving force transfer member being substantially matched, and wherein the cartridge includes a tooth-missing gear that is engaged with a lock tooth provided to the main body in mounting the cartridge to the main body to rotate the joint member and to thus position directions of the joint-side engagement parts in a predetermined range.

According to a fourth illustrative aspect of the present invention, there is provided an image forming apparatus comprising a main body having a driving source and a cartridge detachably mounted to the main body, wherein the main body includes: a rotational member that is rotated as driving force is transferred thereto from the driving source, a driving force transfer member that is coaxially arranged to an end portion of the rotational member in an axial direction thereof and has a first transfer-side engagement part that can be engaged to a rotational member-side engagement part provided to the end portion of the rotational member with a predetermined moving range in a rotational direction, and a press member that presses the driving force transfer member to a position in which the predetermined moving range is secured, wherein the cartridge includes a joint member that is rotatably supported to a case of the cartridge and to which driving force is input from the driving force transfer member, wherein the driving force transfer member has two second transfer-side engagement parts that are provided to sandwich a central axis, wherein the joint member comprises a rotational shaft part that protrudes toward the driving force transfer member and two joint-side engagement parts that are formed to sandwich the rotational shaft part and can be engaged with the two second transfer-side engagement parts with central axes of the joint member and the driving force transfer member being substantially matched, and wherein the cartridge includes a tooth-missing gear that is engaged with a lock tooth provided to the main body in mounting the cartridge to the main body to rotate the joint member and to thus position directions of the joint-side engagement parts in a predetermined range.

According to the cartridge and the image forming apparatus, when the cartridge is mounted to the main body, the directions of the joint-side engagement parts are positioned in a predetermined range. Accordingly, the joint-side engagement parts are not caught at the two transfer-side engagement parts of the driving force transfer member of the main body, so that it is possible to securely match the central axes of the joint member and the driving force transfer member. Accordingly, in this structure, since the joint member and the driving force transfer member are engaged just by moving the joint member toward the driving force transfer member in a diametrical direction, it is possible to make the main body smaller in an axial direction, compared to a structure in which a driving force transfer member is axially advanced and retreated to and from a main body and is thus connected to a cartridge.

According to the invention, it is possible to make the main body smaller.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

Hereinafter, illustrative embodiments of the invention will be specifically described with reference to the drawings. In the meantime, an overall configuration of a laser printer, which is an example of an image forming apparatus, will be first described and characteristic parts of the invention will be then described in details.

In the below descriptions, directions will be described on the basis of a user who uses the laser printer. Namely, in FIG. 1, a left side of paper is referred to as "front side," a right side of paper is referred to as "rear side," an inside of paper is referred to as "left side" and a front side of paper is referred to as "right side." In addition, upper and lower directions of paper are referred to as "upper and lower directions."

Figure 1:
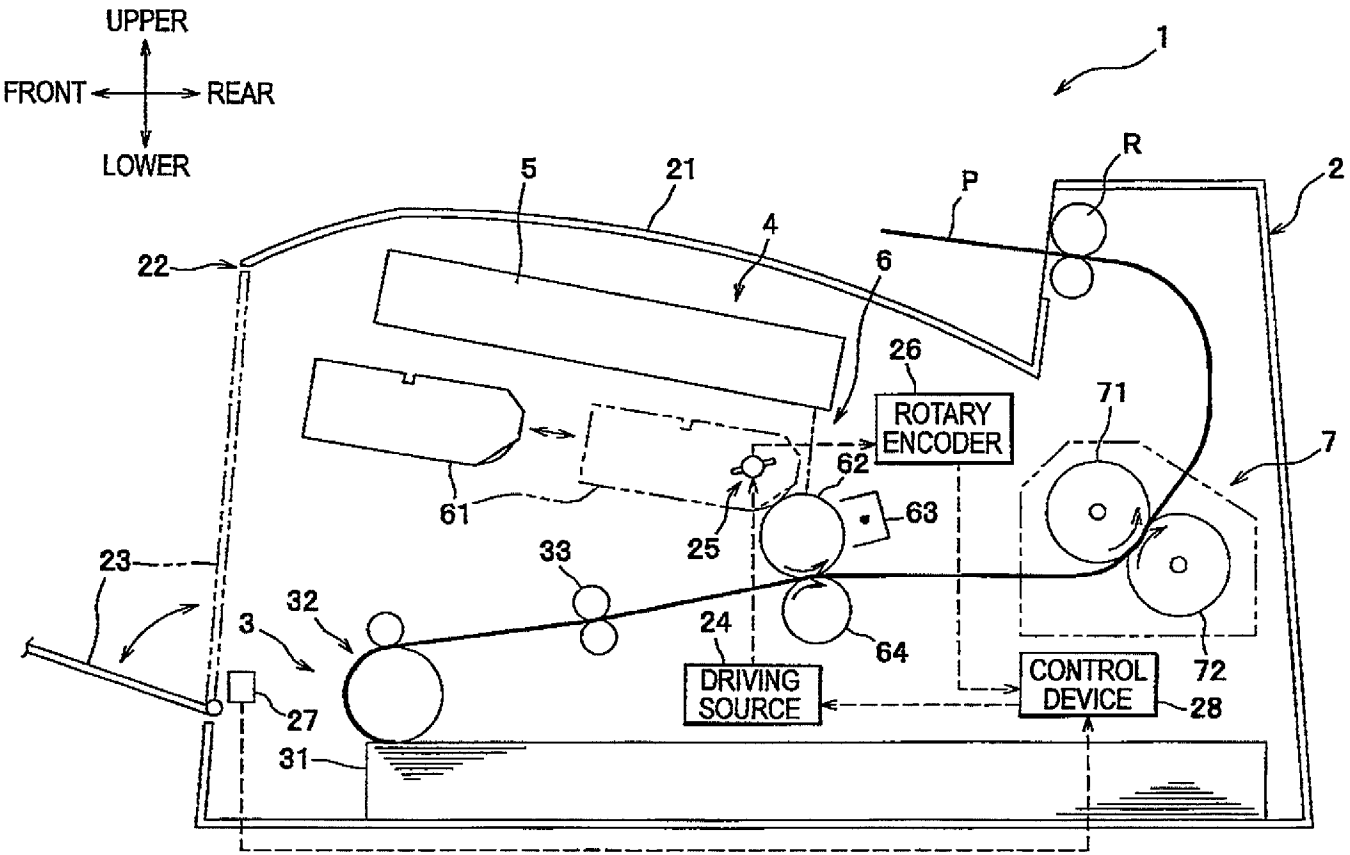
FIG. 1 illustrates a laser printer according to an illustrative embodiment of the invention.

As shown in FIG. 1, a laser printer 1 has a feeder unit 3 that feeds sheets P into a main body 2 and an image forming unit 4 that forms an image on the sheet P.

The feeder unit 3 has a sheet feeding tray 31 that is detachably mounted to a lower part of the main body 2 and a sheet feeding mechanism 32 that feeds sheets P in the feeder tray 31 toward the image forming unit 4.

The image forming unit 4 has a scanner unit 5, a process unit 6, a photographic fixing device 7 and the like.

The scanner unit 5 is provided at an upper in the main body 2 and has a laser light emitting part, a polygon mirror, a lens, a reflector and the like. The scanner unit 5 scans laser beam on a surface of a photosensitive drum 62 at high speed, which will be described later.

The process unit 6 has a developing cartridge 61 that is detachably mounted to the main body 2, a photosensitive drum 62, a charger 63 and a transfer roller 64.

In the process unit 6, a surface of the rotating photosensitive drum 62 is uniformly charged by the charger 63 and then exposed to the laser beam of high speed from the scanner unit 5. Thereby, potential of the exposed part is lowered, so that an electrostatic latent image based on image data is formed on the surface of the photosensitive drum 62.

Then, toner in the developing cartridge 61 is supplied to the electrostatic latent image of the photosensitive drum 62, so that a toner image is formed on the surface of the photosensitive drum 62. After that, the sheet P is conveyed between the photosensitive drum 62 and the transfer roller 64, so that the toner image carried on the surface of the photosensitive drum 62 is transferred on the sheet P.

The photographic fixing device 7 has a heating roller 71 and a pressing roller 72 that is opposed to the heating roller 71 and presses the heating roller 71. In the photographic fixing device 7 configured as described above, the toner transferred on the sheet P is heat-fixed while the sheet P passes through between the heating roller 71 and the pressing roller 72.

In the meantime, the sheet P heat-fixed in the photographic fixing device 7 is conveyed to a sheet discharge roller R arranged downstream from the photographic fixing device 7 and is then discharged on a sheet discharge tray 21 from the sheet discharge roller R.

<Detailed Structure of Main Body 2>

The main body 2 is formed at its front wall with an opening 22 for attaching and detaching the developing cartridge 61 and is provided with a front cover 23 for opening and closing the opening 22 so that the front cover can be rotated. In addition, the main body 2 is provided with a driving source 24, a driving force transfer member 25, a rotary encoder 26, an opening detection sensor 27 and a control device 28 that is an example of return unit.

The driving source 24 is a driving source such as motor and outputs driving force to the driving force transfer member 25 through a gear (not shown).

The driving force transfer member 25 is a member for transferring the driving force to the developing cartridge 61 and is rotatably provided in the main body 2. The driving force transfer member 25 is adapted to rotate as the driving force is transferred thereto from the driving source 24.

Figure 2B:
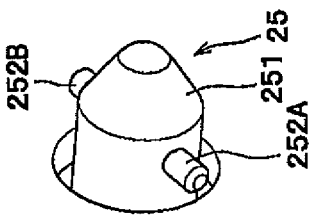
FIG. 2A is a schematic configuration view showing a main body and FIG. 2B is an enlarged perspective view showing a driving force transfer member.
Figure 2A:
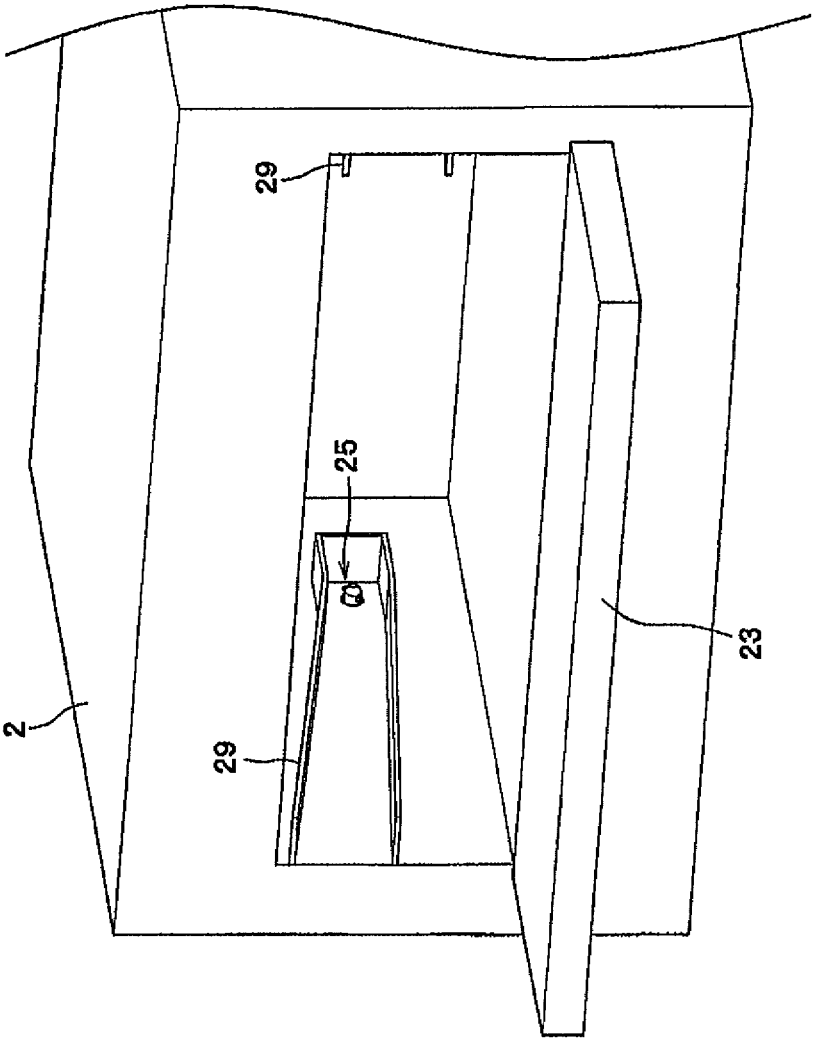

Specifically, as shown in FIGS. 2A and 2B, the driving force transfer member 25 has a rotational shaft part 251 that protrudes toward an inside of the left-right direction (joint member 613 of the developing cartridge 61 mounted to the main body 2, which will be described later) and pin-shaped parts 252A, 252B that are examples of two transfer-side engagement parts protruding from the rotational shaft part 251 in a diametrical direction. The respective pin-shaped parts 252A, 252B are provided so that they sandwich the rotational shaft part 251 and protrude in an opposite direction, respectively.

In addition, the main body 2 is provided with guidance ribs 29 that guide the developing cartridge 61 to a mounting position of the main body 2 (position at which the joint member 613 and the driving force transfer member 25 are coaxial). The guidance ribs 29 guide the developing cartridge 61 while sandwiching left and right sides of the developing cartridge in the upper-lower direction and have such a shape that they are gradually narrowed toward the driving force transfer member 25, respectively.

As shown in FIG. 1, the rotary encoder 26 is a sensor that detects directions (angles) of the respective pin-shaped parts 252A, 252B of the driving force transfer member 25 and is provided to any one rotational shaft of the driving force transfer member 25, a gear for transferring the driving force to the driving force transfer member 25 and the driving source 24. An angle signal detected by the rotary encoder 26 is output to the control device 28.

The opening detection sensor 27 is a sensor (optical sensor, piezoelectric device and the like) that detects opening of the front cover 23. When the opening detection sensor 27 detects the opening of the front cover 23, it outputs an opening signal indicating the opening to the control device 28.

The control device 28 is adapted to always monitor and store the directions of the respective pin-shaped parts 252A, 252B of the driving force transfer member 25 based on the angle signal from the rotary encoder 26 and to control the driving source 24 based on the directions and the opening signal from the opening detection signal 27. Specifically, when the front cover 23 is opened (when the opening signal is received), the control device 28 controls the driving source 24 to rotate the driving force transfer member 25 in a direction (an opposite direction to the driving force transfer direction) that the respective pin-shaped parts 252A, 252B are away from respective projections 133A, 133B, which will be described below, thereby controlling the respective pin-shaped parts 252A, 252B to face toward a predetermined direction.

Here, the "predetermined direction" means a direction along which the joint member 613, which will be described later, can be inserted to a position at which the joint member is coaxial with the driving force transfer member 25. For example, the predetermined direction is a direction shown in FIG. 8 (a direction along which a straight line connecting the respective pin-shaped parts 252A, 252B is not orthogonal to a mounting direction of the developing cartridge 61). In the meantime, the predetermined direction is preferably the same direction as the mounting direction of the developing cartridge 61.

<Detailed Structure of Developing Cartridge 61>

Figure 3:
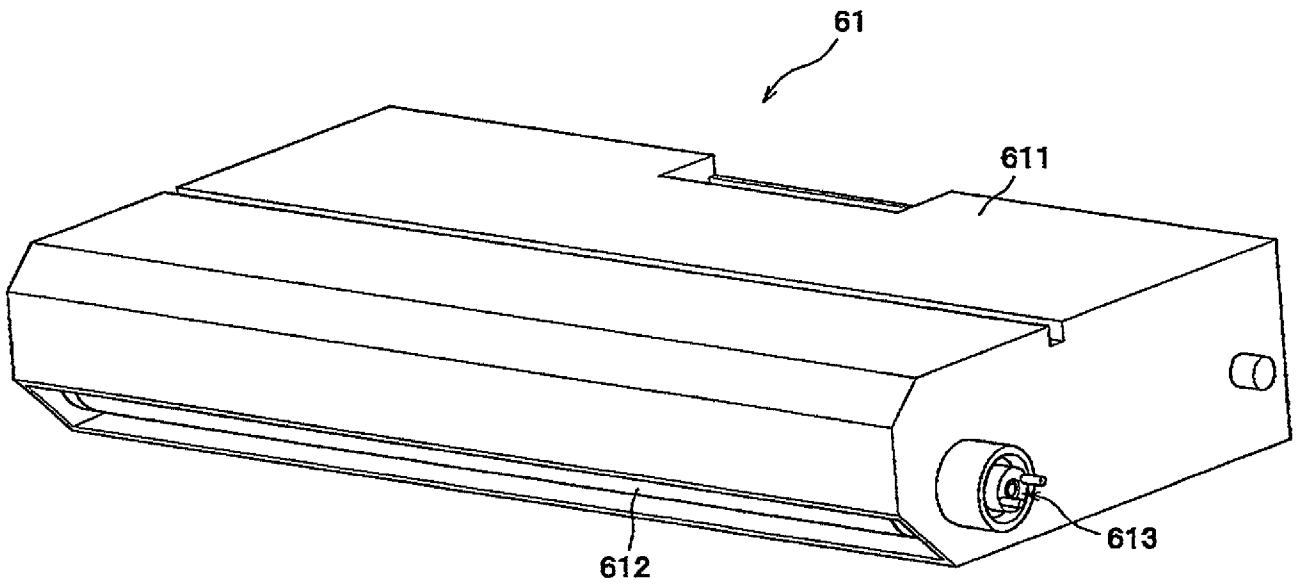
FIG. 3 is a perspective view showing a developing cartridge.

As shown in FIG. 3, the developing cartridge 61 has a case 611, a developing roller 612 that is an example of a rotational body and a joint member 613.

Figure 4:
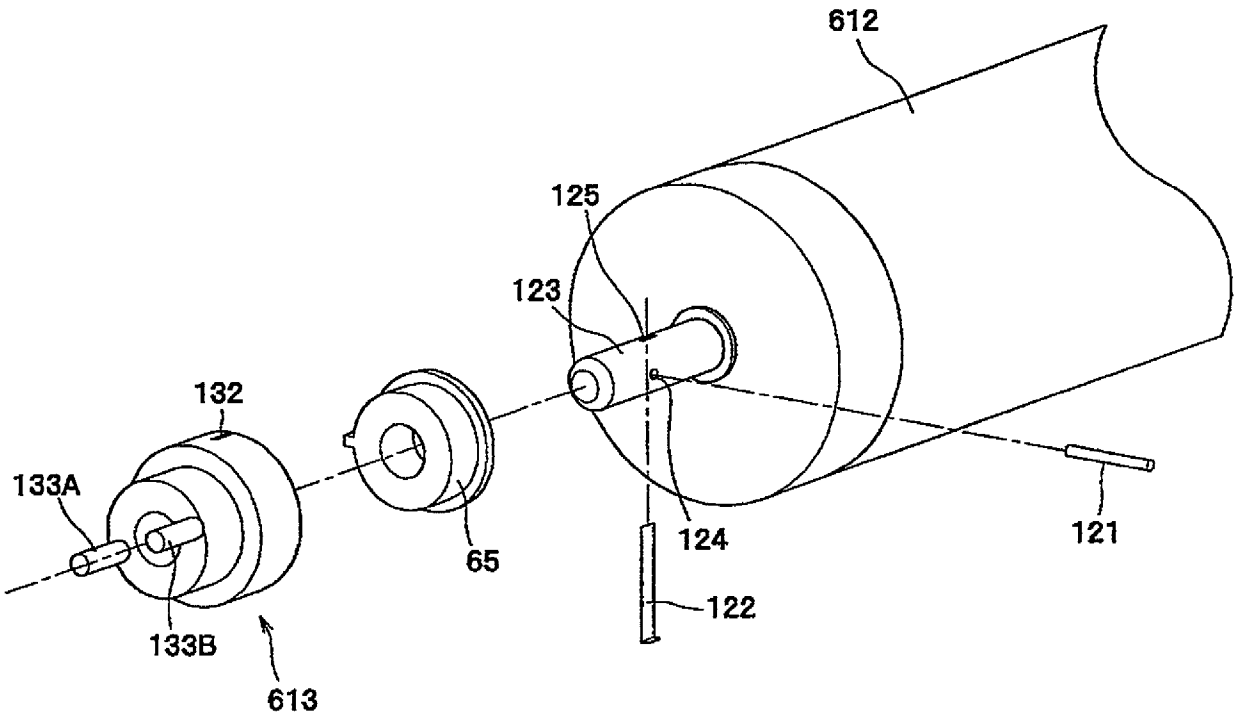
FIG. 4 is an exploded perspective view showing a relation between a developing roller and a joint member.

As shown in FIG. 4, the developing roller 612 is rotatably supported to a bearing 65 that is fixed to the case 611 (refer to FIG. 3) and has at its one end portion a pin 121 that is an example of a rotational body-side engagement part and a plate spring 122 that is an example of a press member. In the meantime, in FIG. 5A, FIG. 6A and FIG. 7A, the bearing 65 is not shown for explanations.

The pin 121 is fitted and fixed in a through-hole 124, which is formed to diametrically penetrate the rotational shaft 123 of the developing roller 612, with its both end portions 121A, 121B (refer to FIG. 5A) protruding in a diametrically outward direction.

The plate spring 122 is fitted and fixed in an attachment hole 125, which is formed to diametrically penetrate the rotational shaft 123 of the developing roller 612, with its one end portion protruding in a diametrically outward direction.

Figure 5A:
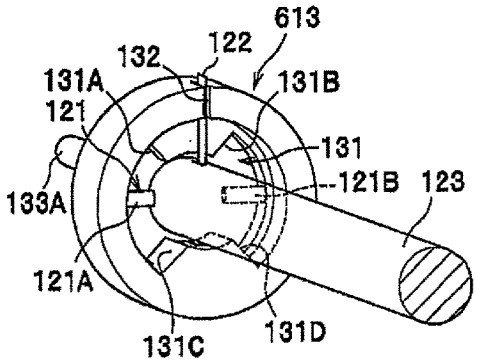
FIG. 5A is a perspective view and FIG. 5B is a side view showing a state in which a joint member is positioned at an initial position.

The joint member 613 is coaxially arranged to one end portion of the developing roller 612 and is rotatably supported to the rotational shaft 123 of the developing roller 612. As shown in FIG. 5A, a surface of the joint member 613, which is opposed to the developing roller 612, is formed with a recessed portion 131 that accommodates a part (one end portion) of the rotational shaft 123 and both end portions (protrusions) 121A, 121B of the pin 121 protruding from the rotational shaft 123 and extend in a rotational direction of both end portions 121A, 121B of the pin 121.

End faces 131A, 131B, 131C, 131D of a rotational direction of the recessed portion 131 are adapted to function as a first joint-side engagement part that can be engaged with both end portions 121A, 121B of the pin 121 with a predetermined moving range in a rotational direction. In addition, the surface of the joint member 613, which is opposed to the developing roller 612, is formed with a slit 132 that is an example of a spring engagement part sandwiching the plate spring 122.

Figure 6A:
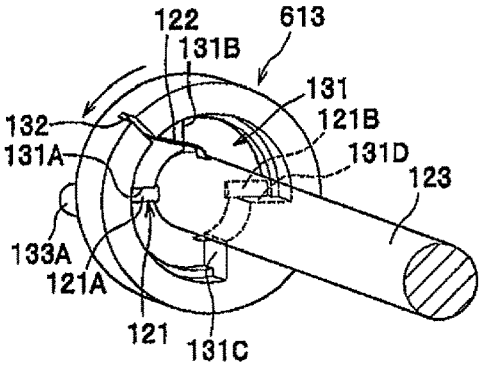
FIG. 6A is a perspective view and FIG. 6B is a side view showing a state in which a joint member is rotated from an initial position to one direction.
Figure 7A:
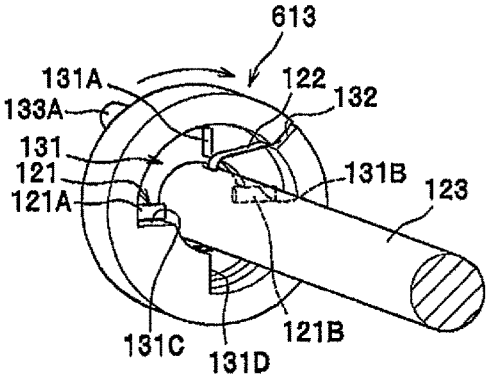
FIG. 7A is a perspective view and FIG. 7B is a side view showing a state in which a joint member is rotated from an initial position to the other direction.

The slit 132 has a width in which the plate spring 122 is sandwiched with a gap from both sides of the rotational direction. Accordingly, as shown in FIG. 6A and FIG. 7A, when the joint member 613 is rotated with respect to the rotational shaft 123, the slit 132 is adapted to permit a leading end portion of the plate spring 122 to move in a diametrical direction while it is engaged with the plate spring 122 in the rotational direction.

In addition, as shown in FIG. 5A, the plate spring 122 entering the slit 132 is configured to press the joint member 613 toward a position at which predetermined moving ranges are secured between both end portions 121A, 121B of the pin 121 and the respective end faces 131A to 131D. Therefore, even though the joint member 613 is rotated with regard to the rotational shaft 123 from an initial position shown in FIG. 5A, as shown in FIG. 6 and FIG. 7A, when the force applied to the joint member 613 is released, the joint member 613 is returned to the initial position due to the pressing force of the plate spring 122.

Figure 5B:
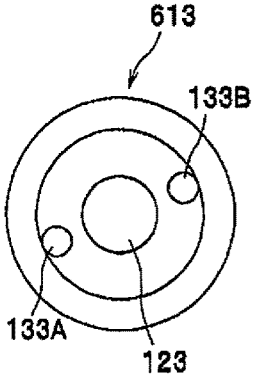

In addition, as shown in FIG. 5B, an axially outer surface of the joint member 613 is provided with projections 133A, 133B, which are examples of two second joint-side engagement parts that can be engaged with the two pin-shaped parts 252A, 252B of the driving force transfer member 25 in a rotational direction under state in which central axes of the joint member 613 and the driving force transfer member 25 (refer to FIG. 2) are substantially matched. As described above, the respective projections 133A, 133B are adapted to relatively rotate with respect to the rotational shaft 123 from a position shown in FIG. 6B to a position shown in FIG. 7B due to the predetermined moving ranges between both end portions 121A, 121B of the pin 121 and the respective end faces 131A to 131D.

<Operations During Mounting of Developing Cartridge 61>

Next, operations of the respective members during the mounting of the developing cartridge 61 will be described.

Figure 8A:
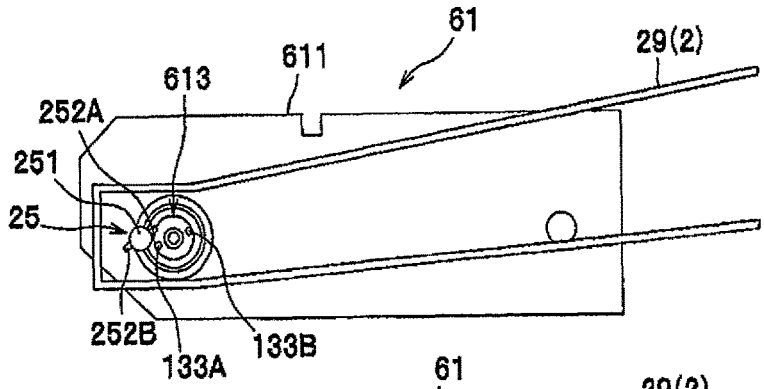
FIGS. 8A to 8D are illustration views showing states of a joint member and a driving force transfer member when mounting a developing cartridge to a main body.
Figure 8B:
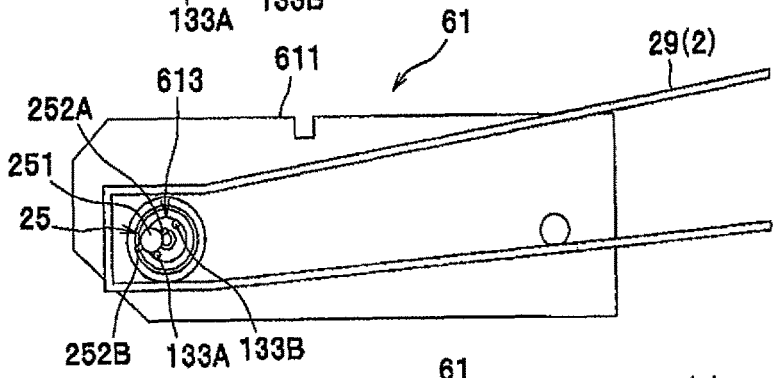
Figure 8C:
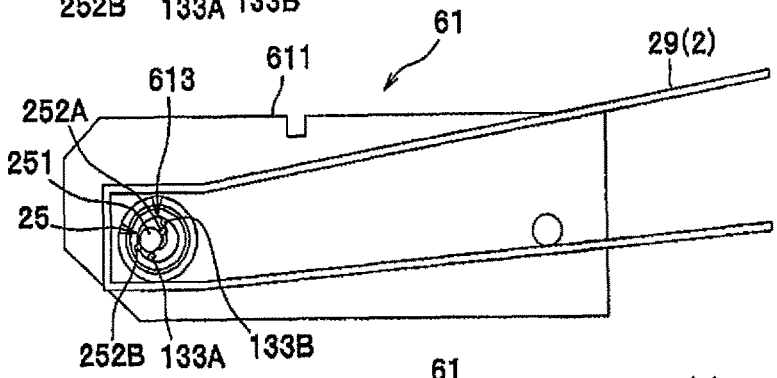

As shown in FIG. 8A, while mounting the developing cartridge 61 along the guidance ribs 29 of the main body 2, when the projection 133A of the joint member 613 is contacted to the rotational shaft part 251 at a position at which the central axes of the driving force transfer member 25 and the joint member 613 are not matched, it is not possible to further push the developing cartridge 61 into the inside at a normal procedure (when the joint member 613 is not rotated within a predetermined moving range). However, in the configuration of this illustrative embodiment, the joint member 613 is adapted to rotate within a predetermined moving range. Thus, as the joint member 613 rotates, the one projection 133A is moved to the inside of a circumferential surface of the rotational shaft part 251 while the protrusion is downwardly displaced along the circumferential surface, as shown in FIGS. 8B and 8C.

Figure 8D:
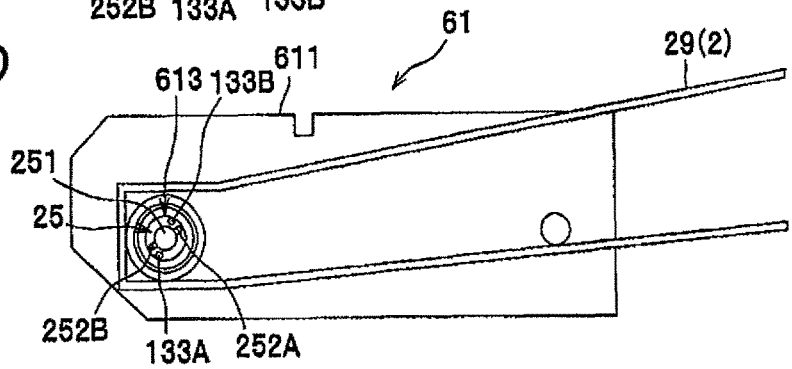

In addition, as the joint member 613 rotates, the other protrusion 133B is upwardly rotated to climb over the pin-shaped part 252A provided to the rotational shaft part 251. Thereby, as shown in FIG. 8D, the central axes of the joint member 613 and the driving force transfer member 25 are matched, so that the respective pin-shaped parts 252A, 252B and the respective projections 133A, 133B can be engaged to each other in the rotational direction.

In the meantime, the directions of the respective projections 133A, 133B of the joint member 613 shown in FIG. 8 indicate the representative directions. However, it should be noted that when the respective projections 133A, 133B are disposed to be more parallel to the mounting direction than the shown direction, the above operation is reproduced. In addition, when the respective projections 133A, 133B are disposed to be steeper with respect to the mounting direction than the direction shown in FIG. 8, it is easier for the driving force transfer member 25 to enter between the respective projections 133A, 133B. Thus, also in this case, it is possible to match the central axes of the joint member 613 and the driving force transfer member 25.

Figure 6B:
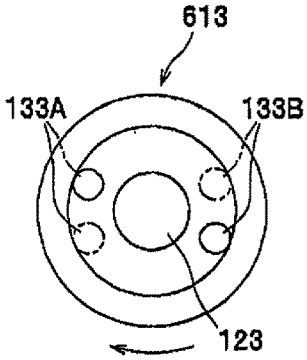
Figure 7B:
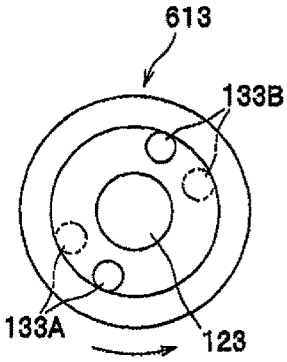

Regarding a printing control operation, when the driving source 24 shown in FIG. 1 is driven, the respective pin-shaped parts 252A, 252B of the driving force transfer member 25 press the respective projections 133A, 133B in the direction shown in FIG. 6B, for example, so that the end faces 131A, 131D of the joint member 613 are engaged to both end portions 121A, 121B of the pin 121 of the rotational shaft 123, as shown in FIG. 6A. Thereby, the driving force transfer member 25, the joint member 613 and the developing roller 612 are integrally rotated, so that the printing control is executed.

After the printing control, under state in which the driving source 24 is simply stopped, the joint member 613 is kept at a posture at which the end faces 131A, 131D are engaged to both end portions 121A, 121B of the pin 121, as shown in FIG. 6A. Accordingly, when the state is kept in opening the front cover 23, the joint member 613 is not rotated within a predetermined moving range, so that the developing cartridge 61 may not be detached from the main body 2.

However, according to this illustrative embodiment, as described above, when the front cover 23 is opened, the control device 28 rotates the driving force transfer member 25 in a direction opposite to a typical (for a case of the printing control and the like) rotational direction, thereby making the respective pin-shaped parts 252A, 252B face toward a predetermined direction. Accordingly, when the front cover 23 is opened, the driving force transfer member 25 is rotated in a direction opposite to the typical rotational direction, so that the joint member 613 shown in FIG. 6A is rotated in a direction opposite to an arrow shown by the pressing force of the plate spring 122 and is thus returned to the initial position shown in FIG. 5A. Thereby, when the developing cartridge 61 is detached from the main body 2, it is possible to easily detach the developing cartridge 61 by using the rotation of the joint member 613 within a predetermined moving range.

According to the above illustrative embodiment, it is possible to obtain following effects.

The joint member 613 and the driving force transfer member 25 are engaged just by moving the joint member toward the driving force transfer member in a diametrical direction. Accordingly, it is possible to make the main body 2 smaller in an axial direction, compared to a structure in which a driving force transfer member is axially advanced and retreated from a main body and is thus connected to a cartridge.

Since the two pin-shaped parts 252A, 252B are engaged with the two projections 133A, 133B in the rotational direction, it is possible to transfer the driving force from the respective pin-shaped parts 252A, 252B to the respective projections 133A, 133B with well balanced.

The structure is adopted in which the plate spring 122 provided to the rotational shaft 123 of the developing roller 612 is engaged in the slit 132 formed at the joint member 613 in the rotational direction and can be moved in the diametrical direction. Thus, it is possible to simplify the structure, compared to a structure in which a spring is connected to both a rotational shaft of a developing roller and a joint member.

The control device 28 is provided which, when opening the front cover 23, rotates the driving force transfer member 25 in a direction along which the pin-shaped parts 252A, 252B are away from the projections 133A, 133B and thus returns the joint member 613 to the initial position by the pressing force of the plate spring 122. Thus, it is possible to easily detach the developing cartridge 61 from the main body 2.

In the meantime, the invention is not limited to the above illustrative embodiment and can be variously changed, as described below. In the below descriptions, the same constitutional elements as those of the above illustrative embodiment are indicated with the same reference numerals and the explanations thereof will be omitted.

Figure 9A:
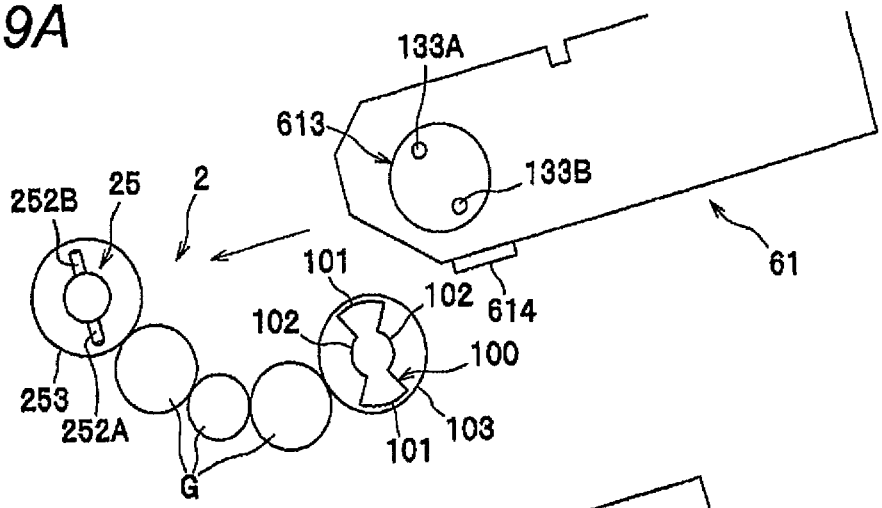
FIGS. 9A to 9C are illustration views showing a shape in which a main body is provided with a tooth-missing gear and a developing cartridge is provided with a lock tooth.

In the above illustrative embodiment, the control device 28 enables the respective pin-shaped parts 252A, 252B to face toward the predetermined direction. However, the invention is not limited thereto. For example, as shown in FIG. 9A, the main body 2 may be provided with a tooth-missing gear 100 that rotates the driving force transfer member 25 to position the directions of the respective pin-shaped parts 252A, 252B within a predetermined range and the developing cartridge 61 may be provided with a lock tooth 614 that is engaged with a gear tooth part 101 of the tooth-missing gear 100.

In the meantime, the tooth-missing gear 100 has the gear tooth part 101 at its part and a tooth-missing part 102 having no gear tooth at its other part. In addition, the tooth-missing gear 100 has a whole circumferential gear tooth part 103 having gear teeth on its whole circumference at a position that is axially offset with the gear tooth part 101. The whole circumferential gear tooth part 103 is adapted to transfer rotational force to a gear part 253, which is configured to integrally rotate with the driving force transfer member 25, through a plurality of gears G. In the meantime, the number of teeth of the gear tooth part 101 and lock tooth 614 may be one or more.

Figure 9B:
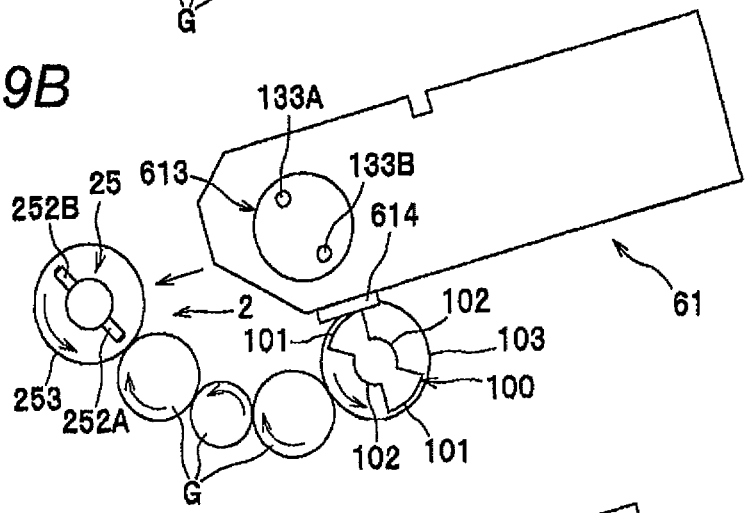

The gear tooth part 101 of the tooth-missing gear 100 is arranged at a position at which it is engaged with the lock tooth 614 when the directions of the respective pin-shaped parts 252A, 252B of the driving force transfer member 25 are substantially orthogonal to the mounting direction of the developing cartridge 61 (when the respective projections 133A, 133B are caught at the respective pin-shaped parts 252A, 252B and the central axes of the joint member 613 and the driving force transfer member 25 cannot be thus matched). According to this configuration, when the lock tooth 614 is engaged with the gear tooth part 101 of the tooth-missing gear 100 while the developing cartridge 61 is mounted to the main body 2, as shown in FIG. 9B, the driving force transfer member 25 is rotated.

Figure 9C:
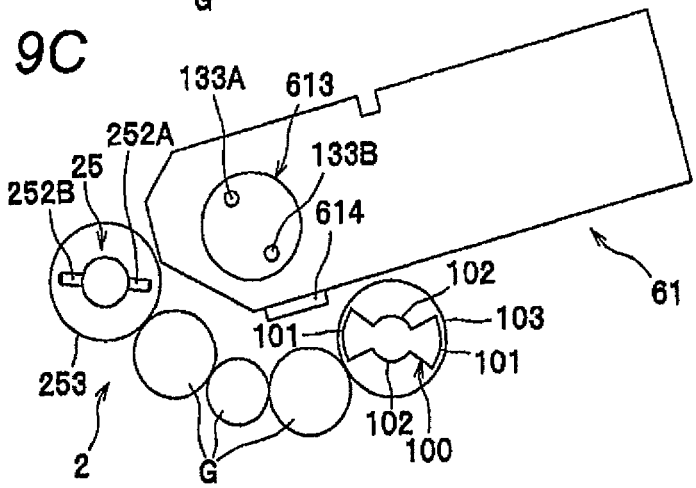

Thereby, as shown in FIG. 9C, the directions of the respective pin-shaped parts 252A, 252B are positioned within a predetermined range and the central axes of the joint member 613 and the driving force transfer member 25 cannot be thus matched. According to this structure, since it is possible to position the directions of the respective pin shaped-parts 252A, 252B without using the sensor or control device as the above illustrative embodiment, it is possible to reduce the costs.

Figure 10A:
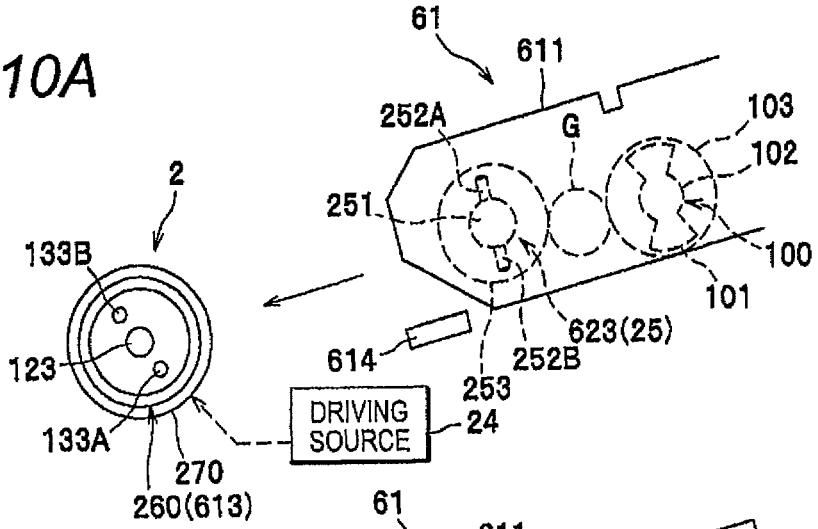
FIGS. 10A to 10C are illustration views showing a shape in which a driving force transfer member has a moving range, a main body is provided with a lock tooth and a developing cartridge is provided with a tooth-missing gear.

In the above illustrative embodiment, the joint member 613 of the developing cartridge 61 is made to have a moving range. However, the invention is not limited thereto. For example, the driving force transfer member of the main body may be provided with a moving range. Specifically, as shown in FIG. 10A, for example, it may be possible that the same member as the joint member 613 of the illustrative embodiment is adopted as a driving force transfer member 260 and the same member as the driving force transfer member 25 of the illustrative embodiment is adopted as a joint member 623.

In other words, the driving force transfer member 260 has the recessed portion 131, the projections 133A, 133B and the like, which are same as the joint member 613 of the illustrative embodiment shown in FIGS. 5A and 5B, and is coaxially arranged at one end of an axial direction of a gear 270 that is rotated as the driving force is transferred from the driving source 24 of the main body 2 thereto. The gear 270 is provided with the rotational shaft 123, the pin 121 and the plate spring 122, which are shown in FIG. 5A.

The joint member 623 has the rotational shaft part 251, the two pin-shaped parts 252A, 252B and the gear part 253 having the rotational shaft part 251 integrated to a center thereof, which are the same as the illustrative embodiment, and is rotatably supported to the case 611. The joint member 623 is coaxially fixed to the developing roller 612 so that it can be integrally rotated. Thereby, the driving force from the driving force transfer member 260 is transferred to the developing roller 612 via the joint member 623.

Here, the recesses portion 131 is an example of the first transfer-side engagement part and the projections 133A, 133B are an example of the second transfer-side engagement part. In addition, the gear 270 is an example of the rotational member and the pin 121 is an example of the rotational member-side engagement part. Furthermore, the plate spring 122 is an example of the press member and the pin-shaped parts 252A, 252B are an example of the joint-side engagement part.

In addition, the developing cartridge 61 is provided with the tooth-missing gear 100 and a gear G having the same configuration as shown in FIG. 9A and the tooth-missing gear 100 is adapted to transfer the rotational force to the gear part 253 of the joint member 623 via the gear G. Furthermore, the main body 2 is provided with the lock tooth 614 having the same configuration as shown in FIG. 9A.

Figure 10B:
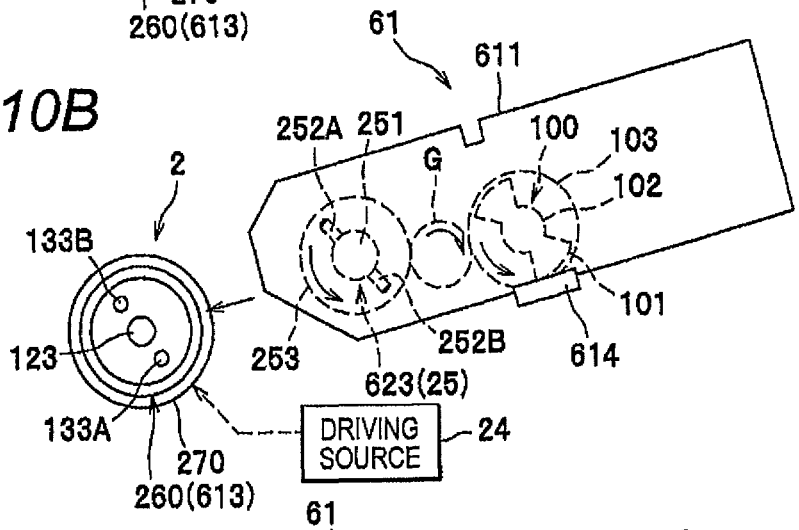
Figure 10C:
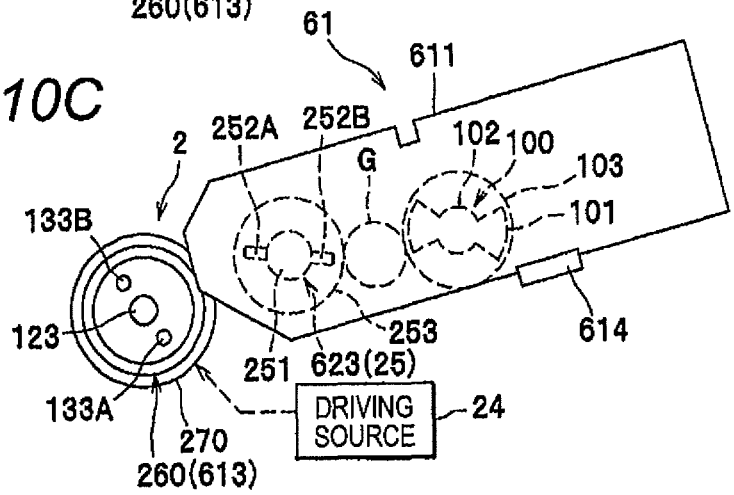

Thereby, when the tooth-missing gear 100 is engaged with the lock tooth 614 provided to the main body 2 while the developing cartridge 61 is mounted to the main body 2, as shown in FIG. 10B, the joint member 623 is rotated. Therefore, as shown in FIG. 10C, the directions of the respective pin-shaped parts 252A, 252B are positioned within a predetermined range and the driving force transfer member 26 is rotated within a predetermined moving range, so that the central axes of the joint member 623 and the driving force transfer member 260 can be matched. According to this configuration, since it is possible to position the directions of the respective pin shaped-parts 252A, 252B without using the sensor or control device, as the above illustrative embodiment, it is possible to reduce the costs.

In the above illustrative embodiments, two second joint-side engagement parts and two transfer-side engagement parts are provided. However, the invention is not limited thereto. For example, one or three or more engagement parts may be provided. In the meantime, for one engagement part, it is not necessary to position the direction of the transfer-side engagement part, as the illustrative embodiment.

In the above illustrative embodiment, the invention is applied to the laser printer 1. However, the invention is not limited thereto. For example, the invention may be applied to other image forming apparatuses, for instance, copier, complex device and the like.

In the above illustrative embodiment, the developing cartridge 61 is adopted as the cartridge. However, the invention is not limited thereto. For example, a process unit having a photosensitive drum or developing roller integrated thereto, a drum cartridge having a photosensitive drum and the like may be adopted.

In the above illustrative embodiment, the developing roller 612 is adopted as the rotational body. However, the invention is not limited thereto. For example, a photosensitive drum, a supply roller and the like may be adopted. In the meantime, it is needless to say that the shapes of the respective engagement parts such as rotational body-side engagement part (pin 121) and first joint-side engagement part (end faces 131A to 131D of the recessed portion 131) in the above illustrative embodiment can be appropriately changed.

Figure 11:
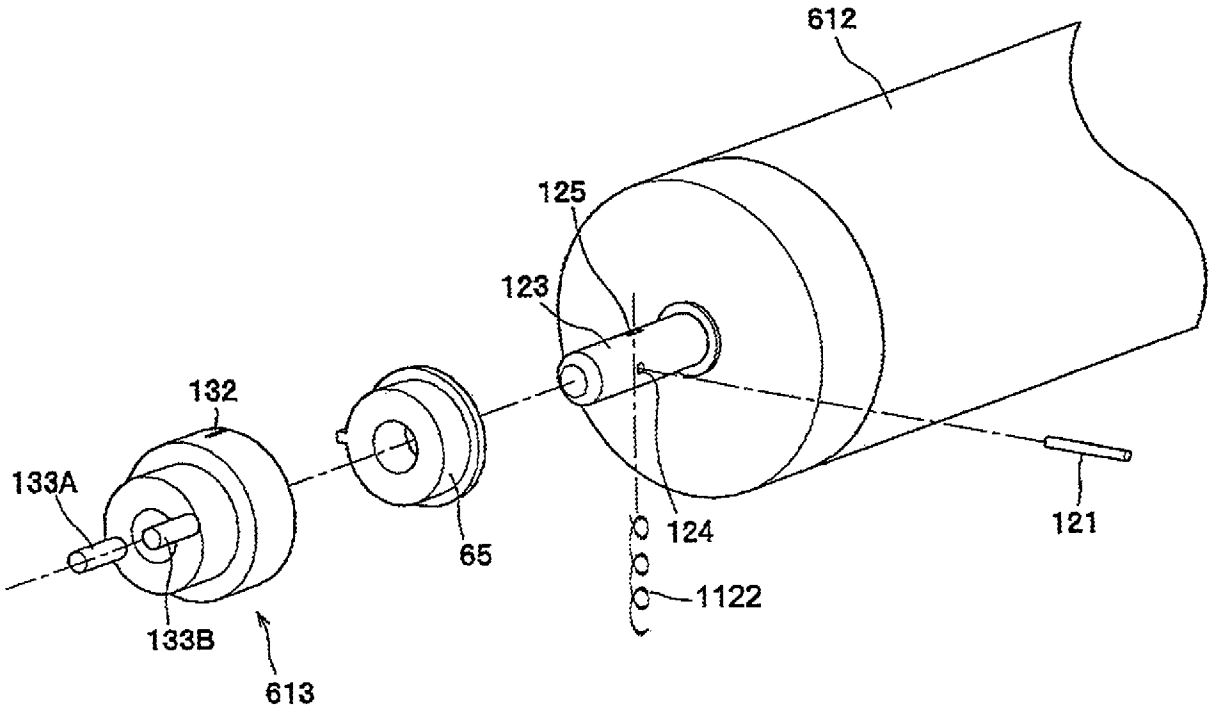
FIG. 11 is an exploded perspective view showing a relation between a developing roller and a joint member.

In the above illustrative embodiment, the plate spring 122 is adopted as the press member. However, the invention is not limited thereto. For example, a coil spring, a line spring and other such wire springs may be also adopted. FIG. 11 shows an a coil spring 1122 made of wire, for example.

In the above illustrative embodiment, the slit 132 is adopted as the spring engagement part. However, the invention is not limited thereto. For example, a pair of pins may be also adopted.

In the above illustrative embodiment, the joint member 613 is rotatably supported to the rotational shaft 123 of the developing roller 612. However, the invention is not limited thereto. For example, the joint member 613 may be rotatably supported to the case 611.

In the above illustrative embodiment, the pin-shaped parts 252A, 252B (transfer-side engagement parts) are integrated to the rotational shaft part 251. However, the invention is not limited thereto. For example, the transfer-side engagement parts may be separately provided from the rotational shaft part as long as the transfer-side engagement parts are provided at positions that are diametrically offset with regard to the rotational shaft part.

In the above illustrative embodiment, the control device 28 is adopted as the return unit that returns the joint member to its initial position by the pressing force of the press member when opening the cover. However, the invention is not limited thereto. For example, it may be possible that a lock tooth, which is interlocked with the opening and closing of the cover, and a tooth-missing gear, which is interlocked with the joint member, are provided and the tooth-missing gear is rotated by a predetermined amount by the lock tooth when opening the cover, thereby returning the joint member to the initial position.

What is claimed is:

1. An image forming apparatus comprising:
a sheet feeding tray;
a scanner unit facing the sheet feeding tray in a longitudinal direction;
a main body having an opening, the opening being positioned between the sheet feeding tray and the scanner unit in the longitudinal direction;
a front cover movable between an opening position to open the opening and a close position to close the opening, the front cover being positioned between the sheet feeding tray and the scanner unit in the longitudinal direction;
a cartridge comprising:
a joint rotatable about an axis extending in an extending direction and movable between a first position and a second position;
a developing roller rotatable with the joint; and
a guide rib extending from the opening toward an inside of the main body, the guide rib configured to guide the cartridge toward an inside of the main body via the opening; and
a driving force transfer member,
wherein the joint is movable from the first position toward the second position, and
wherein the joint moves from the second position toward the first position while the cartridge is moved, along the guide rib, from the opening of the main body to a mounting position at which a printing control is executed in a state where the front cover is at the open position.

2. The image forming apparatus according to claim 1, wherein the joint moves from the second position toward the first position in a state where the pressing force of the pressing member is released.

3. The image forming apparatus according to claim 1, wherein the pressing member is a spring.

4. The image forming apparatus according to claim 1, wherein the joint further includes:
a first projection extending in the extending direction, and
a second projection extending in the extending direction and being spaced apart from the first projection.

5. The image forming apparatus according to claim 1, wherein the first position is a position of the joint relative to a position of the developing roller, and
wherein the second position is a position of the joint relative to the position of the developing roller different from the first position.

6. The image forming apparatus according to claim 1, wherein the cartridge is a process cartridge, and
wherein the cartridge comprises:
the joint;
the developing roller; and
a photosensitive drum.

7. The image forming apparatus according to claim 1, wherein the joint moves from the second position toward the first position while the cartridge is moved through an opening between the sheet feeding tray and the scanner unit.

8. An image forming apparatus comprising:
a sheet feeding tray;
a scanner unit;
a main body having an opening;
a cover movable between an opening position to open the opening and a close position to close the opening;
a developing cartridge comprising:
a joint rotatable about an axis extending in an extending direction and movable between a first position and a second position;
a developing roller rotatable with the joint; and
a pressing member configured to press the joint from the first position toward the second position,
a guide rib extending from the opening toward an inside of the main body, the guide rib configured to guide the developing cartridge toward an inside of the main body via the opening; and a driving force transfer member, wherein the joint is movable from the first position toward the second position in a state where the pressing member presses the joint, wherein the joint moves from the second position toward the first position against the pressing force of the pressing member in a case where the joint engages with the driving force transfer member after the guide rib guides the developing cartridge, and wherein the joint moves from the first position toward a third position different from the first position in a case where the cover is opened in a state where the joint is engaged with the driving force transfer member after the guide rib guides the developing cartridge.

9. The image forming apparatus according to claim 8, wherein the joint moves from the second position toward the first position in a state where the pressing force of the pressing member is released.

10. The image forming apparatus according to claim 8, wherein the pressing member is a spring.

11. The image forming apparatus according to claim 8, wherein the joint further includes:

a first projection extending in the extending direction, and a second projection extending in the extending direction and being spaced apart from the first projection.

12. The image forming apparatus according to claim 8, wherein the first position is a position of the joint relative to a position of the developing roller, and wherein the second position is a position of the joint relative to the position of the developing roller different from the first position, and wherein the third position is a position of the joint relative to the position of the developing roller different from the first position and the second position.

13. The image forming apparatus according to claim 8, wherein the joint moves from the second position toward the first position while the cartridge is moved through an opening between the sheet feeding tray and the scanner unit.

* * * * *